United States Patent [19]

Davenport

[11] 4,384,239

[45] May 17, 1983

[54] ELECTRICAL CIRCUIT FOR GASEOUS DISCHARGE LAMP

[75] Inventor: Donald A. Davenport, Park Ridge, Ill.

[73] Assignee: Micron Industries Corporation, Stone Park, Ill.

[21] Appl. No.: 336,696

[22] Filed: Jan. 4, 1982

[51] Int. Cl.[3] ..... H05B 37/00; H05B 41/16

[52] U.S. Cl. ..... 315/282; 315/173; 315/277; 315/278; 315/239; 315/DIG. 4

[58] Field of Search ..... 315/282, DIG. 4, 277, 315/278, 227 R, 239, 240, 241, 173

[56] References Cited

U.S. PATENT DOCUMENTS 3,440,490 4/1969 Parish ..... 315/227

4,284,925 8/1981 Bessone et al. ..... 315/240

*Primary Examiner*—Harold A. Dixon

*Attorney, Agent, or Firm*—Robert E. Wagner; Leo J. Aubel

[57] ABSTRACT

An improved electrical circuit for selectively controlling the power to a gaseous discharge lamp. One use for such circuit and lamp is in an ink-curing process for objects printed with multiple-colored ink wherein areas of the object are printed and cured in a multiple-step operation.

7 Claims, 3 Drawing Figures

ELECTRICAL CIRCUIT FOR GASEOUS DISCHARGE LAMP

BACKGROUND OF THE INVENTION

A prior art circuit related to the invention is shown in FIG. 1 and includes a switch means for controlling the power applied to a gas lamp in stepped fashion. In addition to the lamp and switch, the circuit includes a transformer having a secondary winding connected to the lamp, and capacitors connected in parallel to one another and in series with the lamp and secondary winding. The gas lamp and circuit of FIG. 1 are useful in a variety of applications wherein the power to the lamp is varied at selected time periods.

As will be explained hereinafter, the prior art has various disadvantages. The present invention provides an improvement of the prior art circuit and, more particularly, provides means of reducing the electrical and mechanical stress developed across the circuit capacitors connected to the lamp to thereby increase the life of the capacitors and thus obtain a more useful circuit.

SUMMARY OF THE INVENTION

The present invention is particularly directed to providing an improved circuit for controlling the power applied to a gas lamp and, more particularly, a circuit wherein the secondary winding of the transformer supplying power is coupled in a unique manner with the capacitors in the circuit to utilize the inductance of the secondary to limit the surges of current into and out of the capacitors to thereby avoid the stresses developed therein when the gas lamp is switched.

BRIEF DESCRIPTION OF THE DRAWINGS

The foregoing features and advantages of the present invention will be apparent from the following more particular description of the invention. The accompanying drawings, listed hereinbelow, are useful in explaining the invention wherein.

DESCRIPTION OF THE INVENTION

Figure 1:
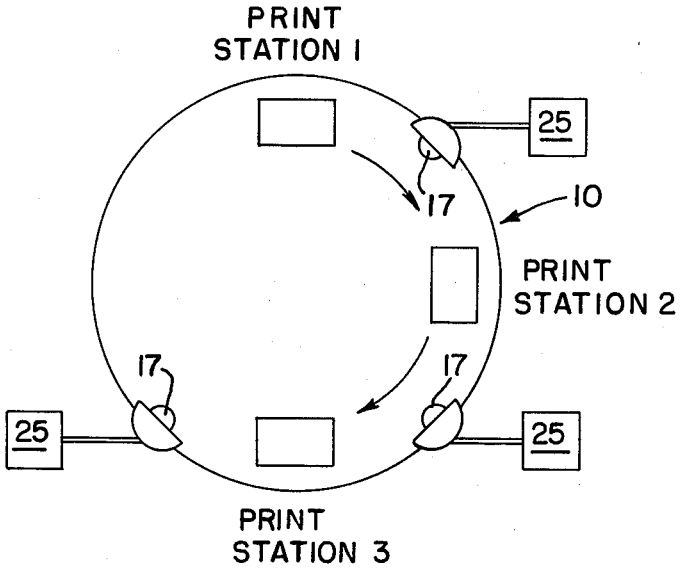
FIG. 1 is a sketch of an application of the invention.

Refer first to FIG. 1 to obtain an appreciation of one important application of the invention. FIG. 1 shows a sketch of a portion of one type of apparatus for effecting multiple-color printing, as is known in the art. Assume, for example, that an object (such as a T-shirt) is to be printed with a multiple (say, three) color design. As is known, the portion of the design which is of one color may be printed at print station 1. Next, the machine conveys the object toward a print station 2. As the object is in transition between print stations 1 and 2, a gas lamp 17, positioned intermediate the stations, is energized to cure the ink. At print station 2, a second color is printed, and the process is repeated.

To reduce power consumption, and also to extend the life of the lamp, the light intensity of lamp 17 is lowered after an object is moved past the lamp. When the next object moves past the lamp, the intensity of the lamp is again increased to properly affect and cure the ink, and the process is repeated. It will be obvious that multiple lamps may be positioned and selectively switched along the processing path.

Figure 2:
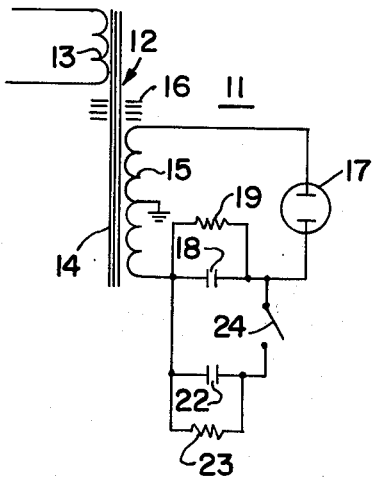
FIG. 2 PRIOR ART
FIG. 2 is a circuit diagram of the prior art.

FIG. 2 discloses a gas lamp control circuit 12, as is known in the prior art. Transformer 12, of a high reactance type, may be of laminated core construction 14, and includes a primary or input winding 13 and a secondary or output winding 15 which may be centered tapped. A shunt 16 provides an additional magnetic path between the primary and secondary windings. A gas lamp 17, of conventional design, has one of its electrodes connected to one terminal of secondary winding 15, and its other electrode connected in series with a resonant capacitor 18 to the other terminal of secondary winding 15. A bleeder resistor 19 is connected across capacitor 18. A second resonant capacitor 22 is connected, through a switch 24, in parallel to capacitor 18. A bleeder resistor 23 is connected across capacitor 22.

When transformer 15 is energized, the secondary winding 15 provides a voltage to initiate an arc between the electrodes in the lamp 17. When the lamp 17 initially arcs or "strikes", the lamp draws appreciably greater current than its normal operating current. The transformer 15, in conjunction with the impedance of capacitors 18 and/or 22, limits the current to a safe value. As the lamp 17 heats up, its impedance increases until it reaches its design operating level of voltage and current. The secondary winding 15, capacitors 18 and/or 22, and lamp 17 form a series circuit which, at the lamp's operating parameters, combine in a ferro-resonant circuit, saturating the core 14. This achieves the effect of providing a relatively constant wattage level to lamp 17 over a wide range of input voltage to the primary winding 13, as well as compensating for changes in the operating parameters caused such as by the aging of the lamp 17. Gas lamp 17 operates at reduced power when switch 24 is open and operates at full power when switch 24 is closed.

The foregoing prior art circuit of FIG. 2 provides a reduction in the operating power level of the lamp 17 by controlling the value of the capacity connected in series with the lamp by switching capacitor 22 in and out of the circuit. An inherent weakness of the prior art circuit of FIG. 2 is that, as capacitor 22 is switched in and out of the circuit, capacitor 18 is subjected to extremely high electrical stress. Such stress damages capacitor 18 and can cause it to fail. For example, assume that switch 24 is closed and lamp 17 is operating at full power. To reduce power output of the lamp, switch 24 is opened, removing capacitor 22 from the circuit and causing resistor 23 to bleed off the charge in capacitor 22. To again initiate full power to lamp 17, switch 24 is closed, again placing capacitor 22 in parallel with charged operating capacitor 18. At this point, capacitor 22 is discharged and, hence, appears as an electrical short-circuit across capacitor 18. Since the lowest impedance circuit to charge capacitor 22 is from the charge in capacitor 18, capacitor 18 is, in theory, required to provide infinite current to charge capacitor 22. In attempting to provide such current, capacitor 18 is subjected to extremely high electromechanical stress. Under certain operating conditions, the total impressed voltage increases the stored energy four times since, as is known, the watt seconds of energy varies with the square of the voltage and the two capacitor voltages are additive.

Figure 3:
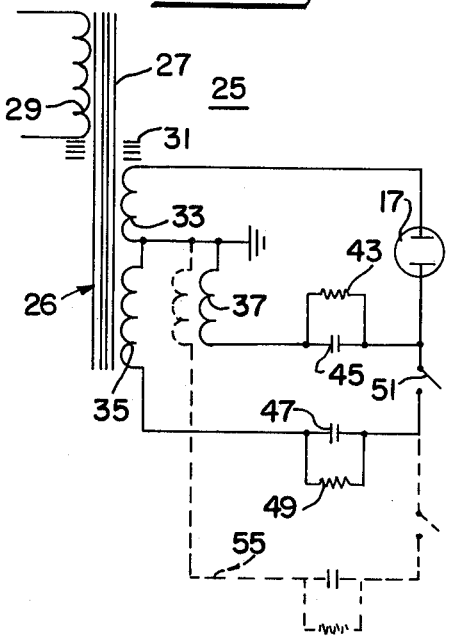
FIG. 3 is a circuit diagram of the invention.

The present invention will minimize the foregoing problem associated with the prior art circuit. Refer now to FIG. 3, which shows the circuit 25 of my invention. In FIG. 3, a transformer 26 includes a core 27, a primary winding 29 and a magnetic shunt 31, all similar to the structure of FIG. 2. However, the secondary or output winding circuitry connected to the gas lamp 17 is different from that of FIG. 2. In FIG. 3, transformer 26 includes secondary or output windings 33, 35 and 37. In the embodiment shown, secondaries 33, 35 and 37 are all equal in voltage.

Secondary 33 has one terminal connected to one electrode of lamp 17. A capacitor 45 connects to the other electrode of lamp 17 through secondary 37 to the other terminal of secondary 33 and to ground reference. A bleeder resistor 43 is connected across capacitor 45. A switch 51 connects the other electrode of lamp 17 through a capacitor 47 to secondary 35 and thence to ground, and a bleeder resistor 49 is connected across capacitor 47.

Secondary 33 delivers full-rated current, and secondaries 35 and 37 each deliver current to the lamp 17 proportional to the ratio that capacitors 45 and 47 are to the total circuit capacity.

Importantly, the invention provides a ferro-resonant constant wattage-type ballast system wherein each of the capacitors 47 and 49, in series with the lamp 17, has its own respective secondary winding 37 and 35 for delivering to the capacitor and lamp that percentage of the lamp current desired. For example, if the two capacitors 47 and 49 and secondary windings 37 and 35 are of equal value and current capacity, then, with both capacitors switched to the circuit, the lamp 17 operates at full (100%) power. With switch 51 open, that is, with capacitor 47 and secondary 35 being disconnected, the lamp 17 operates at one-half (50%) of its rated current.

As indicated by the dotted lines 55, additional capacitors, switches and secondary windings may be included. If there were switches and secondary windings may be included. If there were four capacitors (each one-fourth of total capacity required for full power operation of the lamp) and four secondary windings (each of equal voltage rating and one-fourth of the total required current rating), it would be possible, with three switches similar to switch 24, to control the power to the lamp in steps of 25%, 50%, 75% and 100%, with any damages effects to the capacitors as their inrush charging current is limited by the inherent current limiting characteristics of the transformer.

While the invention has been particularly shown and described with reference to a preferred embodiment thereof, it will be understood by those skilled in the art that various changes in form and details may be made therein without departing from the spirit and scope of the invention.

I claim:

1. In a multi-color printing apparatus including a gaseous discharge lamp, a circuit for selectively controlling the power applied to said lamp, comprising, in combination, a transformer having a primary winding and a plurality of of output windings, said lamp having first and second electrodes, a first of said output windings having a terminal connected to one electrode of said lamp, a first capacitor connected in a circuit path from said second electrode to a second output winding; switch means, and a second capacitor connected in series to a third output winding and through said switch means to said second electrode, respective resistors connected across said capacitors, said second and third output windings having respective terminals connected in common to the other terminal of said first output winding, and said switch means being actuable to selectively connect said second capacitor in the operating circuit path of said lamp to control the power to said lamp, whereby said output windings connected to said capacitors provide current limiting characteristics for limiting the inrush charging current to the capacitors to thereby minimize electromechanical stresses therein.

2. A circuit as in claim 1 having at least three output windings, at least three capacitors connected in series with respective ones of said output windings, and switch means for selectively connecting said capacitors to said lamp, whereby the power applied to said lamp may be changed in selected steps.

3. A circuit as in claim 1 wherein the voltages developed across said output windings are all essentially equal.

4. A circuit as in claim 1 wherein the capacitors are of a selected capacity whereby the current delivered by the output winding is proportional to the ratio that the capacitors are of the total capacity.

5. A circuit as in claim 1 wherein the second and succeeding output windings and associated capacitors are connected in parallel with one another.

6. A circuit as in claim 5 wherein switch means are provided for selectively connecting said succeeding output windings and associated capacitors to said lamp.

7. A circuit for selectively controlling the power applied to a gaseous discharge lamp, comprising, in combination, a transformer having a primary winding and a plurality of output windings, said lamp having a pair of electrodes, a first of said output windings having a terminal connected to one electrode of said lamp, a first capacitor connected in a circuit path from said other electrode to a second output winding; switch means, and a second capacitor connected in series to a third output winding and through said switch means to said other electrode, respective resistors connected across said capacitors, said second and thrid output windings having respective terminals connected in common to said first output winding, said switch means being actuable to selectively connect said second capacitor in the operating circuit path of said lamp to control the power to said lamp and said output windings connected to said capacitors providing current limiting characteristics therefor.

* * * * *